US008714394B2

(12) United States Patent
Wulf

(10) Patent No.: US 8,714,394 B2
(45) Date of Patent: May 6, 2014

(54) STORAGE CONTAINER HAVING LOCKING LID

(75) Inventor: Franz-Jörg Wulf, Emsdetten (DE)

(73) Assignee: EMSA GmbH, Emsdetten (DE)

( * ) Notice: Subject to any disclaimer, the term of this patent is extended or adjusted under 35 U.S.C. 154(b) by 0 days.

(21) Appl. No.: 13/981,993

(22) PCT Filed: Jan. 30, 2012

(86) PCT No.: PCT/EP2012/051476

§ 371 (c)(1),
(2), (4) Date: Jul. 26, 2013

(87) PCT Pub. No.: WO2012/101288

PCT Pub. Date: Aug. 2, 2012

(65) Prior Publication Data

US 2013/0306636 A1 Nov. 21, 2013

(30) Foreign Application Priority Data

Jan. 28, 2011 (DE) ..... 10 2011 000 392

(51) Int. Cl.
*B65D 45/22* (2006.01)

(52) U.S. Cl.
USPC ..... 220/326; 220/318; 220/324; 220/784; 220/788

(58) Field of Classification Search
USPC ..... 220/318, 323, 324, 326, 784, 788
See application file for complete search history.

(56) References Cited

U.S. PATENT DOCUMENTS 3,294,274 A * 12/1966 Spitzberg ..... 220/803
3,688,942 A * 9/1972 Mitchell et al. ..... 220/784
3,811,597 A * 5/1974 Frankenberg et al. ..... 220/284
3,817,419 A * 6/1974 Moller et al. ..... 220/315
3,840,152 A * 10/1974 Hodge ..... 220/783
4,119,239 A * 10/1978 Anderson ..... 220/324
4,494,674 A * 1/1985 Roof ..... 220/784
4,674,650 A * 6/1987 Hamilton et al. ..... 220/319
4,966,294 A * 10/1990 Mack et al. ..... 220/266
4,966,302 A * 10/1990 Hjordie ..... 220/268
5,538,154 A * 7/1996 Von Holdt ..... 220/277
5,574,254 A * 11/1996 Mori et al. ..... 174/561

(Continued)

FOREIGN PATENT DOCUMENTS

DE 20320088 U1 5/2005
DE 202010007217 U1 9/2010

(Continued)

*Primary Examiner* — Gregory Pickett
*Assistant Examiner* — Ned A Walker
(74) *Attorney, Agent, or Firm* — Karl F. Milde, Jr.; Eckert Seamans Cherin & Mellott, LLC

(57) ABSTRACT

A storage container set comprises multiple plastic lid elements (20, 30) and a common container element (10), the side wall (11) of which has outward-protruding locking projections (12) that have a downward-extending locking profiled section (14) at their outer ends and are provided for locking the alternatively placeable lid elements. The first lid element (30) has hinged locking clips (31) for gripping the locking projections. The second lid element (20) has a continuous peripheral edge profile (21) and a vertical profiled section (22) which embraces the locking projections (12) from outside when the second lid element (20) is placed on the container element. A profiled tongue (23) at the end of the vertical profiled section (22) resiliently engages with the locking projections (12) while temporarily and peripherally tensioning the profiled section (22).

6 Claims, 4 Drawing Sheets

(56) References Cited

U.S. PATENT DOCUMENTS

| | | | | |
|---|---|---|---|---|
| 5,641,065 | A * | 6/1997 | Owens et al. | 206/370 |
| 5,887,745 | A * | 3/1999 | Wood | 220/326 |
| 5,960,979 | A * | 10/1999 | Van Den Brink et al. | 220/266 |
| 6,415,947 | B1 * | 7/2002 | Kim | 220/788 |
| 6,609,623 | B2 * | 8/2003 | Chou | 220/4.23 |
| 6,644,492 | B1 * | 11/2003 | Mitchell | 220/285 |
| 6,793,096 | B1 * | 9/2004 | Seok | 220/788 |
| 7,032,773 | B2 * | 4/2006 | Dees et al. | 220/793 |
| 7,063,231 | B2 * | 6/2006 | Stanos et al. | 220/793 |
| 7,090,089 | B2 * | 8/2006 | Lown et al. | 220/324 |
| 7,118,003 | B2 * | 10/2006 | Sellari et al. | 220/266 |
| 7,255,228 | B2 * | 8/2007 | Kim | 206/320 |
| 7,261,219 | B2 * | 8/2007 | Tucker et al. | 220/793 |
| 7,264,135 | B2 * | 9/2007 | Savicki et al. | 220/781 |
| 7,357,272 | B2 * | 4/2008 | Maxwell | 220/785 |
| 7,726,483 | B2 * | 6/2010 | Ramanujam et al. | 206/508 |
| 7,731,049 | B2 * | 6/2010 | Dengel et al. | 220/284 |
| 7,784,633 | B2 * | 8/2010 | Luburic | 220/285 |
| 7,854,344 | B2 * | 12/2010 | Suk | 220/326 |
| 8,056,750 | B2 * | 11/2011 | Vovan | 220/270 |
| 8,186,531 | B2 * | 5/2012 | Parikh et al. | 220/266 |
| 8,376,176 | B2 * | 2/2013 | Dengel et al. | 220/284 |
| 8,496,133 | B2 * | 7/2013 | Mizukoshi et al. | 220/693 |
| 2004/0084464 | A1 * | 5/2004 | Koo | 220/784 |
| 2005/0006390 | A1 * | 1/2005 | Wang | 220/326 |
| 2005/0035125 | A1 * | 2/2005 | Bae | 220/326 |
| 2005/0051549 | A1 | 3/2005 | Nelson | |
| 2005/0139604 | A1 * | 6/2005 | Kim | 220/788 |
| 2006/0011631 | A1 * | 1/2006 | Dengel et al. | 220/270 |
| 2006/0213916 | A1 * | 9/2006 | Brown et al. | 220/780 |
| 2007/0007298 | A1 * | 1/2007 | Tucker et al. | 220/791 |
| 2007/0045317 | A1 * | 3/2007 | Rosender et al. | 220/266 |
| 2007/0119743 | A1 * | 5/2007 | Tucker et al. | 206/503 |
| 2007/0138180 | A1 * | 6/2007 | Vovan | 220/266 |
| 2008/0087669 | A2 * | 4/2008 | Boback et al. | 220/266 |
| 2008/0110911 | A1 * | 5/2008 | Chen | 220/788 |
| 2008/0197134 | A1 * | 8/2008 | Maxwell | 220/367.1 |
| 2008/0203096 | A1 * | 8/2008 | Maxwell | 220/374 |
| 2009/0084796 | A1 * | 4/2009 | Coonce et al. | 220/508 |
| 2009/0218360 | A1 * | 9/2009 | Suk | 220/784 |
| 2010/0078433 | A1 * | 4/2010 | Mizukoshi et al. | 220/200 |
| 2010/0243654 | A1 * | 9/2010 | Dengel et al. | 220/284 |
| 2011/0017746 | A1 * | 1/2011 | Franczyk et al. | 220/524 |
| 2011/0031246 | A1 * | 2/2011 | Massey et al. | 220/214 |
| 2012/0234832 | A1 * | 9/2012 | Franczyk et al. | 220/23.87 |

FOREIGN PATENT DOCUMENTS

| | | | |
|---|---|---|---|
| EP | 1475313 | A2 | 11/2004 |
| WO | 0144058 | A2 | 6/2001 |
| WO | 0151374 | A1 | 7/2007 |

* cited by examiner

STORAGE CONTAINER HAVING LOCKING LID

BACKGROUND OF THE INVENTION

The invention relates to a storage container set comprising at least two lid elements made of synthetic material and a common container element, which has a minimum of one protruding locking projection, having at its outer end a downward facing locking profiled section, wherein a first lid element has at least two locking clips for connection to the locking projection of the container element, each of these locking clips being connected to the outer rim of the lid via a living (i.e., film-formed) hinge.

Just such a combination of a container and of a lid element with locking clips is shown in DE 203 20 088 U1. It allows for a very secure and tight closure and thus for the transport of food even in liquid form. A clearly noticeable sound is created when closing the locking clips, signaling to the user that a secure closure has occurred.

Despite the stated advantages, closing the locking clips is associated with an excessive exertion of force for certain groups of users such as children and seniors.

SUMMARY OF THE INVENTION

An objective of the present invention is to provide a storage container set of the type described above with a second lid element which is combinable with the known container elements, yet requires less force for closing, whereby an acoustic feedback for the user is also effected with this second configuration of a container and a lid of the storage container set.

The objective is achieved according to the invention by providing a second lid element for the container element having a continuous rim profile extending along the circumference and enclosing the locking projections of the essentially known container element from the outside using a vertical profiled section. When placing the second lid element onto the container element, a profiled tongue tensions a profiled section of the lid element in the circumferential direction when overcoming the looking projections. In the end, the profiled tongue engages with a spring action under the locking projection.

The pretension is effected at that moment when the portion of the rim profile that extends the furthest to the inside overcomes the profiled section of the locking projection that extends the furthest to the outside. Once the profiled tongue of the lid has overcome this point, it can engage abruptly with a spring action underneath the locking projection. Adjacent areas of the lid and of the container are placed abruptly in front of each other, causing the sound.

The effect can be intensified in that not only is the lid element elastically pre-tensioned at the moment of placing it onto the container element but also in that the locking profiled section of the locking projection is pressed in the direction of the side wall using the profiled tongue at the lid element and is thus also pre-tensioned.

Preferably, the elasticity of the lid is set such that the absolute elongation of the profiled tongue is small. In case of a rectangular container, the user can then pull the lid over only one corner and not over all corners at the same time. In this manner he can observe the acoustic feedback several times.

To permit an elastic deformation of the locking profiled section at the locking projection of the container element, the locking profiled section is connected at an angle to the locking projection and is positioned especially at an angle of $\alpha$=15°-30°, in particular 25° relative to the vertical axis of the container downward and outward.

A continuous locking projection can extend along the outside of the side wall of the container element.

As an alternative, a minimum of two pairs of locking projections located opposite each other can be arranged at the outer side of the side wall.

For a full understanding of the present invention, references should now be made to the following detailed description of the preferred embodiments of the invention as illustrated in the accompanying drawings.

DESCRIPTION OF THE PREFERRED EMBODIMENTS

Figure 1:
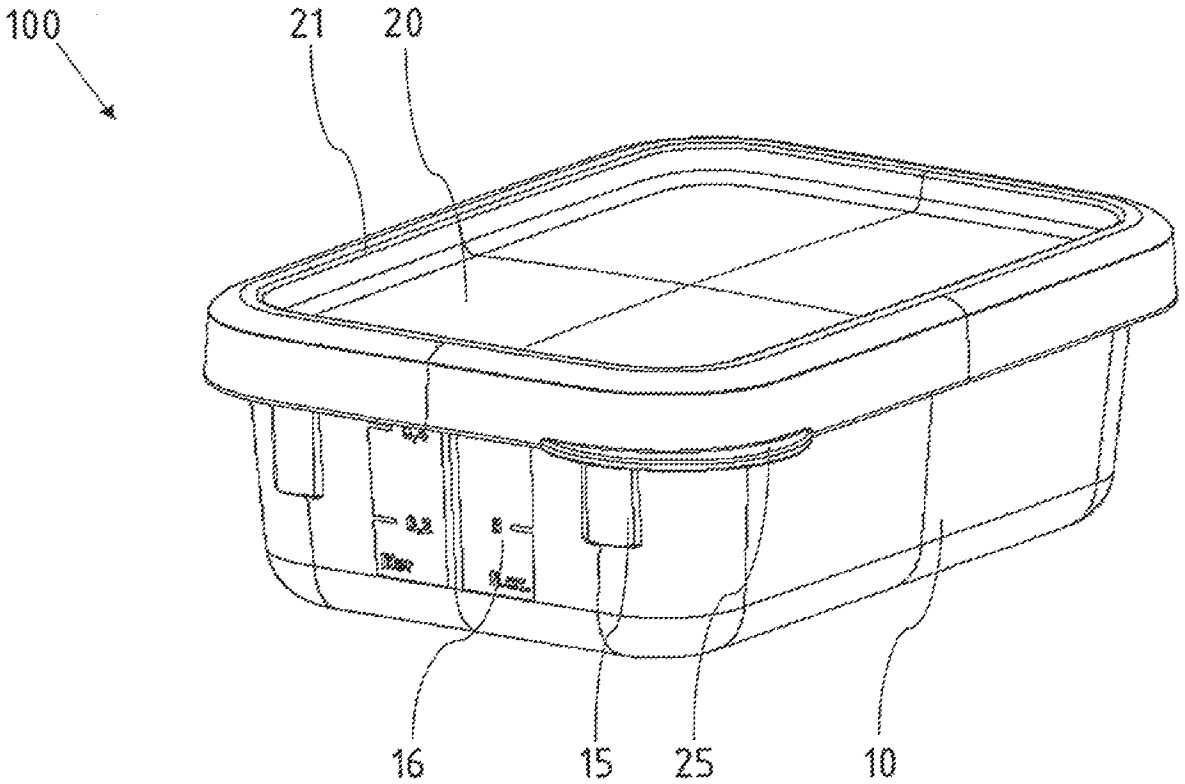
FIG. 1 shows a perspective view of a storage container having a lid element according to the invention.

The preferred embodiments of the present invention will now be described with reference to FIGS. 1-5 of the drawings. Identical elements in the various figures are designated with the same reference numerals.

FIG. 1 shows a bowl-shaped container element 10, open at the top, as is used in households as a freshness-preserving container. A lid element 20 consisting of a minimum of two lid elements of the storage container set is placed on top.

The embodiment of a storage container 10 shown here has stacking aids 15 molded onto its outside. In case several container elements 10 are placed into each other, the stacking aids 15 form a stop and prevent the containers from sticking to each other. In addition, air circulation is enabled because the stacked container elements 10 no longer have an air-tight connection.

Furthermore, the container element 10 of the preferred embodiment shown has a scale section 16.

Figure 2:
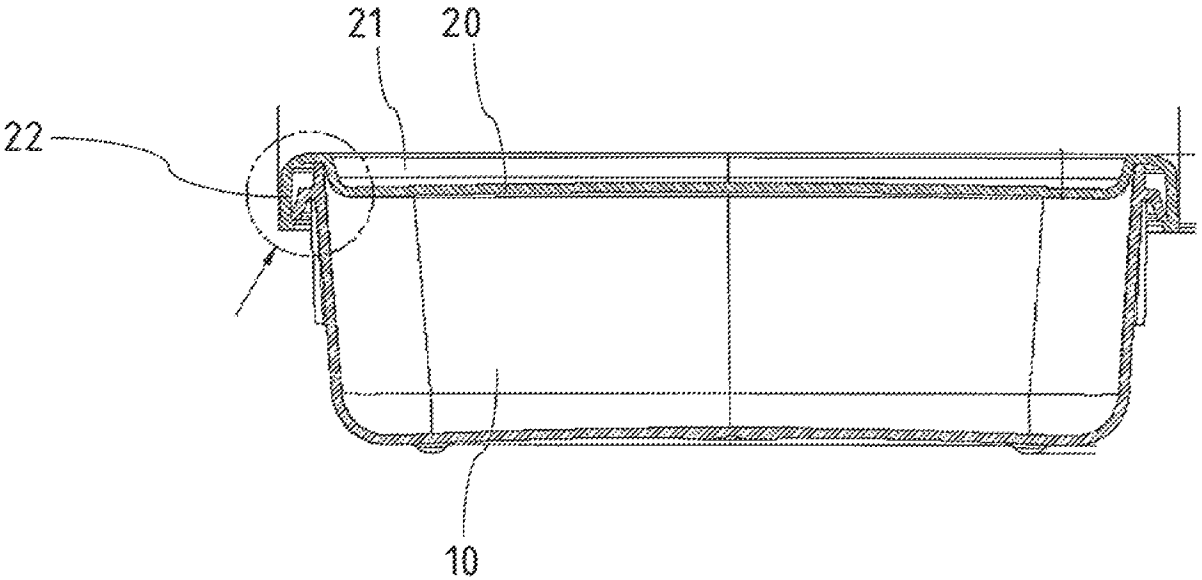
FIG. 2 is a cross-sectional view of the storage container of FIG. 1.
Figure 3:
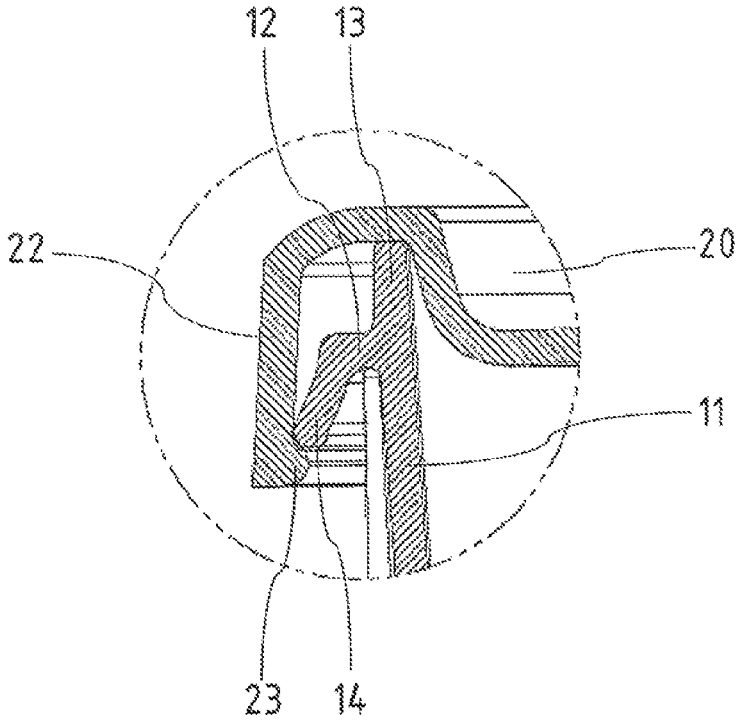
FIG. 3 is a detailed view of the rim profile according to FIG. 2.

The lid element 20 has a rim profile 21 that fully surrounds the edge area of the container element 10, as is apparent especially in the sectional view of FIG. 2 as well as the magnified view of the edge area in FIG. 3.

One side wall 11 of the container element 10 ends in an upper edge 13 that serves in particular as a support for sealing rings or sealing areas at the lid element.

Arranged at the outside of the side wall 11 is a locking projection 12 that is placed perpendicular to the side wall 11 with its first profiled section. This is followed by a locking profiled section 14 that runs at an angle outward and downward and is positioned especially at an angle of about 15° to 30°, in particular 25° relative to the vertical axis of the container.

The rim profile 21 of lid element 20 extends from a central area that is located slightly lower than the upper edge 13 of the container element 10 upwards to above the upper edge 13 and than runs down again in a vertical profiled section 22 on the outside parallel to the side wall 11, i.e., at such a distance that the rim profile 21 fully encloses also the locking profiled section 14 that protrudes outward.

At the lower end, the profiled section 22 ends in a profiled tongue 23 that faces inward. This does not have to be a longer profiled section, rather a thickened area at the lower end of profiled section 22 is sufficient, as shown in the embodiment.

This so-called profiled tongue 23 extends like a cord once across the entire circumference at the lower edge of the rim of the lid element 20 and is tensioned when it passes by at the protruding locking tongue 14 of the container element 10. Once it has passed this point, the profiled tongue 23 deflects abruptly. In this process, the adjacent areas of the profiled section 22 strike against the locking tongue 14 such that a sound is created, which signals a secure closure to the user.

Since the lid is made of a soft, flexible synthetic material, especially polyethylene with a hardness of 40 . . . 55 Shore D, in particular about 48 Shore D, and the container element on the other hand of a hard synthetic material, especially a polypropylene copolymer with a hardness of 55 . . . 75 Shore D, in particular 60 . . . 70 Shore D, good sealing is achieved when the upper edge 13 of the container element 10 presses against the soft synthetic material of the lid element 20. The profiled shape of the lid in the area that extends beyond the upper edge 13 promotes pre-tensioning in the vertical direction, i.e., when the rim profile of the second lid element 20 engages with a spring action under the locking projection not only temporary pre-tensioning in the direction of the circumference that leads to acoustic feedback is achieved but also permanent pre-tensioning of the lid element 20 toward the upper edge 13 as long as the locking connection is in existence.

Figure 4:
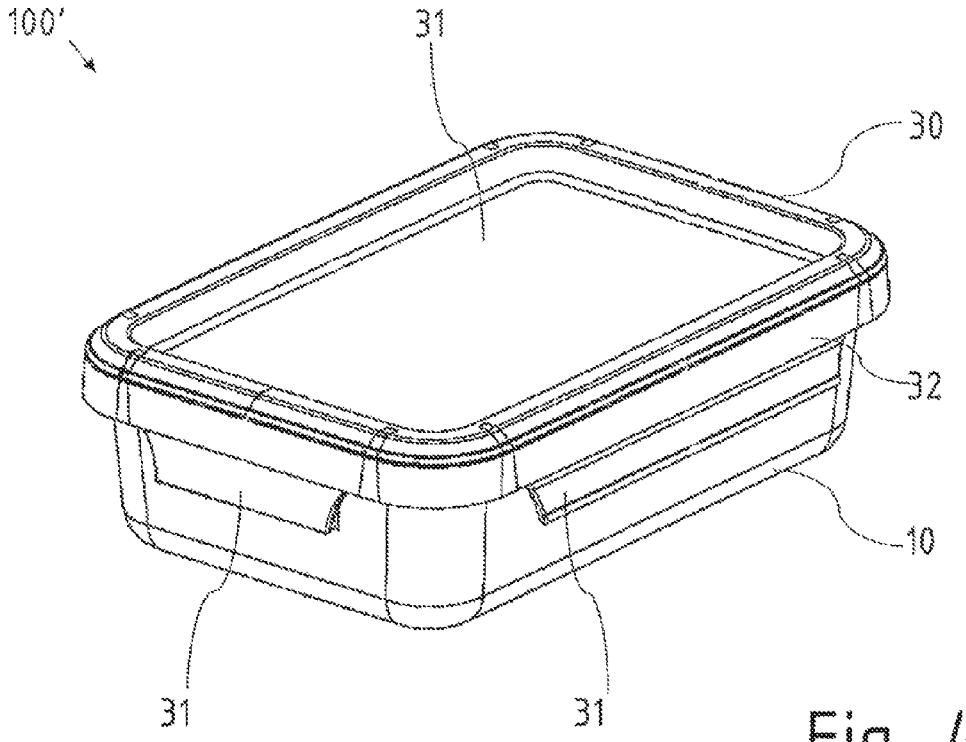
FIG. 4 is a perspective view from above of a storage container with a lid according to the invention.

FIG. 4 shows a combination of a second, essentially known, lid element 30 from the storage container set with the container element 10. The rectangular lid element 30 has locking clips 31.

Figure 5:
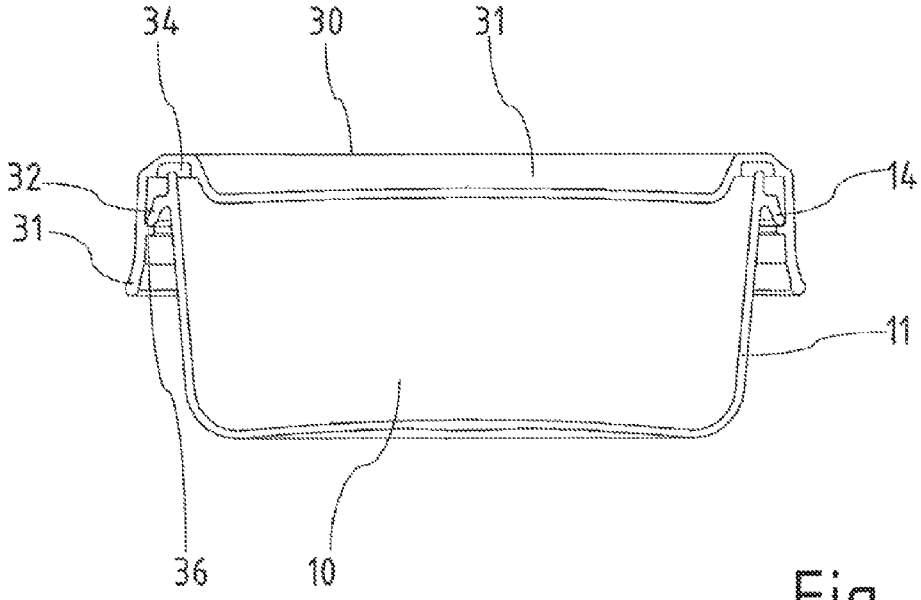
FIG. 5 shows a section through the storage container of FIG. 4.

FIG. 5 shows a sectional view of the combination shown in FIG. 4. As soon as the lid element 30 is pressed on and its locking edge 36 has passed the tip of the locking projection 14 at the storage container 20, the locking projection 32 clamps itself positively under the locking edge 16 and secures the lid 30 tightly at the container element 10. Here too the sealing is achieved in that a flexible area 34 in the lid is pressed against the upper edge of the container. The locking clip 31 can be released again by pulling at the end that protrudes downward beyond the locking projection 14.

There has thus been shown and described a novel storage container set which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A storage container assembly comprising;
- a container comprising:
  - a closed base;
  - an angled sidewall extending upwardly from said closed base to an upper rim defining an open top; and
  - at least one locking projection having:
    - an upper shoulder substantially spaced from the upper rim, the upper shoulder outwardly protruding from an upper portion of the sidewall;
    - a flared sidewall downwardly extending from the upper shoulder and having a resilient outer distal end substantially spaced from an outer surface of the angled sidewall;
- a lid comprising:
  - a closed recessed top;
  - an upper shoulder having:
    - an interior sidewall surrounding the closed recessed top;
    - a planar top wall seated on the upper rim of the container; and
    - a beveled outer edge; and
  - a continuous outer skirt downwardly extending from the beveled outer edge of the upper shoulder, the outer skirt having:
    - a substantially vertical sidewall covering the at least one locking projection of the container;
- a fastening tongue inwardly protruding from a lower distal end of the vertical sidewall, the fastening tongue securing the resilient outer distal end of the flared sidewall of the at least one locking projection, and at least two locking clips connected to the continuous outer skirt via a living hinge and fastened to the at least one locking projection of the container.

2. The storage container assembly as in claim 1, wherein the flared sidewall of the at least one locking projection is placed at an angle of $\alpha$ in the range of 15°-30° relative to a vertical axis of the container.

3. The storage container assembly as in claim 1, wherein the container is made of a hard polypropylene copolymer with a hardness in the range of 55-75 Shore D and wherein the lid is made of a flexible polyethylene with a hardness in the range of 40-55 Shore D.

4. The storage container assembly as in claim 1, wherein the at least one locking projection is a continuous locking projection extending along the angled sidewall.

5. The storage container assembly as in claim 1, wherein the a minimum of two pairs of locking projections, each located opposite each other, are arranged at the outer side of the container wall.

6. The storage container assembly as in claim 1, wherein the locking profiled section of the locking projection is pressed at the lid in the direction of the container sidewall and pre-tightened by the fastening tongue.

* * * * *